US005582448A

United States Patent [19]

Inoue

[11] Patent Number: 5,582,448

[45] Date of Patent: Dec. 10, 1996

[54] SWITCH MECHANISM FOR A VEHICLE DOOR LOCKING DEVICE

[75] Inventor: Jiro Inoue, Yamanashi-ken, Japan

[73] Assignee: Mitsui Kinzoku Kogyo Kabushiki Kaisha, Tokyo, Japan

[21] Appl. No.: 266,867

[22] Filed: Jul. 5, 1994

[30] Foreign Application Priority Data

Jul. 5, 1993 [JP] Japan ..... 5-191723

[51] Int. Cl.[6] ..... E05C 3/00

[52] U.S. Cl. ..... 292/336.3; 70/275; 212/201

[58] Field of Search ..... 70/277, 278, 280, 70/262–264, 275; 292/336.3, 144, 201

[56] References Cited

U.S. PATENT DOCUMENTS

| | | | |
|---|---|---|---|
| 4,452,058 | 6/1984 | Noel | 292/216 |
| 4,502,718 | 3/1985 | Sasaki et al. | 292/201 |
| 4,706,512 | 11/1987 | McKernon et al. | 292/336.3 |
| 4,995,658 | 2/1991 | Shiraki et al. | 292/336.3 |
| 5,005,329 | 4/1991 | Shibata | 292/201 |
| 5,028,084 | 7/1991 | Fukumoto et al. . | |
| 5,035,453 | 7/1991 | Fukumoto et al. | 292/336.3 |
| 5,072,975 | 12/1991 | Hamada et al. | 292/201 |
| 5,240,296 | 8/1993 | Kobayashi | 292/336.3 |
| 5,261,711 | 11/1993 | Mizuki et al. | 292/201 |
| 5,409,277 | 4/1995 | Rogers, Jr. et al. | 292/201 |

FOREIGN PATENT DOCUMENTS

| | | | |
|---|---|---|---|
| 0190587 | 7/1990 | Japan | 70/275 |
| 2034802 | 6/1980 | United Kingdom | 70/263 |
| 2254880 | 10/1992 | United Kingdom | 70/275 |
| 2262769 | 6/1993 | United Kingdom | 292/201 |

*Primary Examiner*—Darnell M. Boucher
*Attorney, Agent, or Firm*—Browdy and Neimark

[57] ABSTRACT

A vehicle door locking device comprises a first locking lever connected to an inside lock button for changing over the locking device to the lock state or unlock state, a second locking lever connected to a key cylinder and an actuator which has a roughly enclosed housing, a motor accommodated in the housing, a first shaft connected to the first locking lever and a second shaft connected to the second locking lever. A first switch mechanism for detecting the position of the first locking lever and a second switch mechanism for detecting the position of the second locking lever are provided in the housing.

6 Claims, 7 Drawing Sheets

SWITCH MECHANISM FOR A VEHICLE DOOR LOCKING DEVICE

FIELD OF THE INVENTION

The present invention relates to a switch mechanism for a vehicle door locking device.

PRIOR ARTS

A conventionally known vehicle door locking device is provided with a switch mechanism for detecting whether the locking device is locked or unlocked and another switch mechanism for detecting the operation of the door key cylinder (Refer to U.S. Pat. No. 5,028,084). These switch mechanisms are used to control a central door lock system etc with which, when the remote control transmitter and door locking device for the driver's seat are changed over to LOCK or UNLOCK, the remaining locking device is operated in line therewith.

The two switch mechanisms are usually installed at separate positions. For example, in the above US Patent, a key operation detecting switch mechanism (Refer to 205 in FIGS. 22*a* and 22*b* of the US Patent) is installed in an exposed state at the middle of the rear side of the locking device while the state detecting switch mechanism (Refer to 123 in FIGS. 12, 17, and 21) is installed in the actuator housing.

When the switch mechanisms are installed in an exposed state as they are installed in a combination of fixed contacts and movable contacts, it has been necessary to cover the contacts in a resin made casing like the key operation detecting switch mechanism of the US Patent. However, if the contacts are covered with a resin made casing, the switch mechanism will be made bigger and the position of their installation will be limited, thereby causing some problems to remain.

As shown in the above US Patent, in a case where the two switch mechanisms are installed at separated positions, the cables connected to the switch mechanisms will be very complicated.

OBJECT OF THE INVENTION

It is therefore an object of the invention to devise two switch mechanisms so that they are installed in an actuator housing.

PREFERRED EMBODIMENTS OF THE INVENTION

Figure 2:
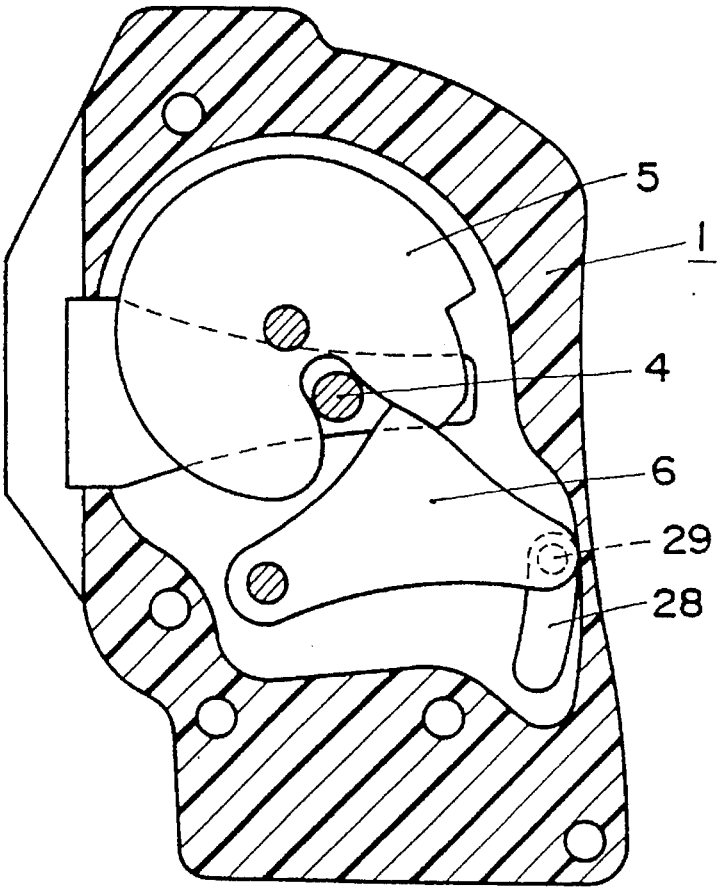
FIG. 2 is a front elevation view of the lock body.

A locking device according to the present invention has a lock body 1 and an actuator 2 fixed at the lower part of the body 1 with screws 3. At the front side of the body 1 are provided a latch 5 which rotates in engagement with a striker 4 fixed at the vehicle body and a ratchet 6 for preventing reverse turning of the latch 5 as shown in FIG. 2. A ratchet pin 29 which protrudes rearwards via a slot 28 of the body 1 is attached to the ratchet 6.

An opening lever 7 is pivotally fixed by shaft 8 at the upper position at the rear side of the body 1, and a bent end portion 11 of a rod 10 extending to an opening handle 9 of a door is engaged with the left end side of the opening lever 7. A longitudinal link 12 which has an upper end portion engaged with the bent end portion 11 is provided at the left side of the rear side of the body 1.

The actuator 2 is provided with a housing A consisting of a cover case 13 and base case 14, and first and second shafts 15 and 16 protruding outwards from the housing A. As made clear in FIG. 3, the second shaft 16 is made cylindrical to cover the outside of the first shaft 15. The first shaft 15 and the second shaft 16 rotate independently. A first or inside lock lever 17 which is connected to a rod 22 extending to an inside lock button 21 of the door is fixed at the exposed end portion of the first axis 15. The first (or inside) lock lever 17 has a bent piece 25 engageable with a long slot 26 formed at the lower end of the link 12. A second or key lock lever 18 which is connected to a rod 20 extending to a key cylinder 19 of the door is fixed at the exposed end portion of the second axis 16.

Figure 1:
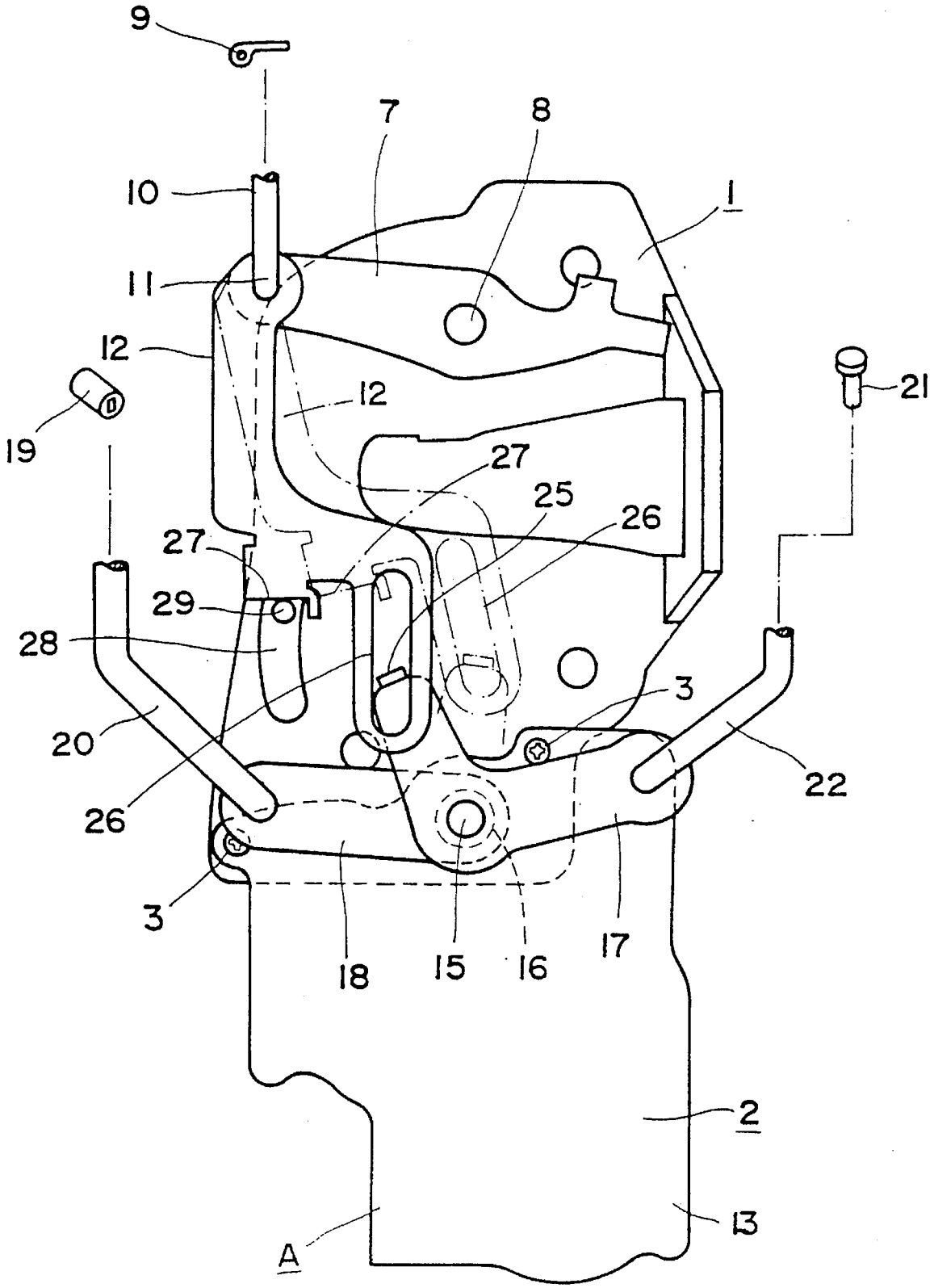
FIG. 1 is a rear elevation view of a locking device according to the invention.

The first lock lever 17 can be changed over to the UNLOCK position shown with a solid line in FIG. 1 or to the LOCK position shown with a dashed line therein by the operation of the lock button 21 or the drive of the actuator 2. In a case where the link 12 is moved downwards by the opening handle 9 of the door while being in the unlocked state, a bent portion 27 of the link 12 causes the ratchet pin 29 to be moved downwards, and the ratchet 6 is released and freed from the latch 5, thereby causing the door to be opened. However, in a locked state, as the bent portion 27 is separated from the pin 29, the door will not be able to be opened even by operating the opening handle 9.

The second lock lever 18 is normally held at the neutral position shown in FIG. 1 by the action of the key cylinder 19 when the key cylinder is not operated. The second lock lever 18 is relatively connected to the first lock lever 17 via the internal mechanism of the actuator 2.

The internal structure of the actuator 2 is described with reference to FIG. 3 through FIG. 5. An electric motor 30 is provided in the housing A, and a gear 32 is fixed on a rotating shaft 31 of the motor 30. A reduction gear 33 and reduction gear 34 are engaged with the gear 32 one after another. A fan-shaped output member 35 is rotatably supported on the second shaft 16, and serrations (threaded portion) 36 engageable with the second reduction gear 34 are formed at the outer circumferential portion of the output member 35.

Figure 3:
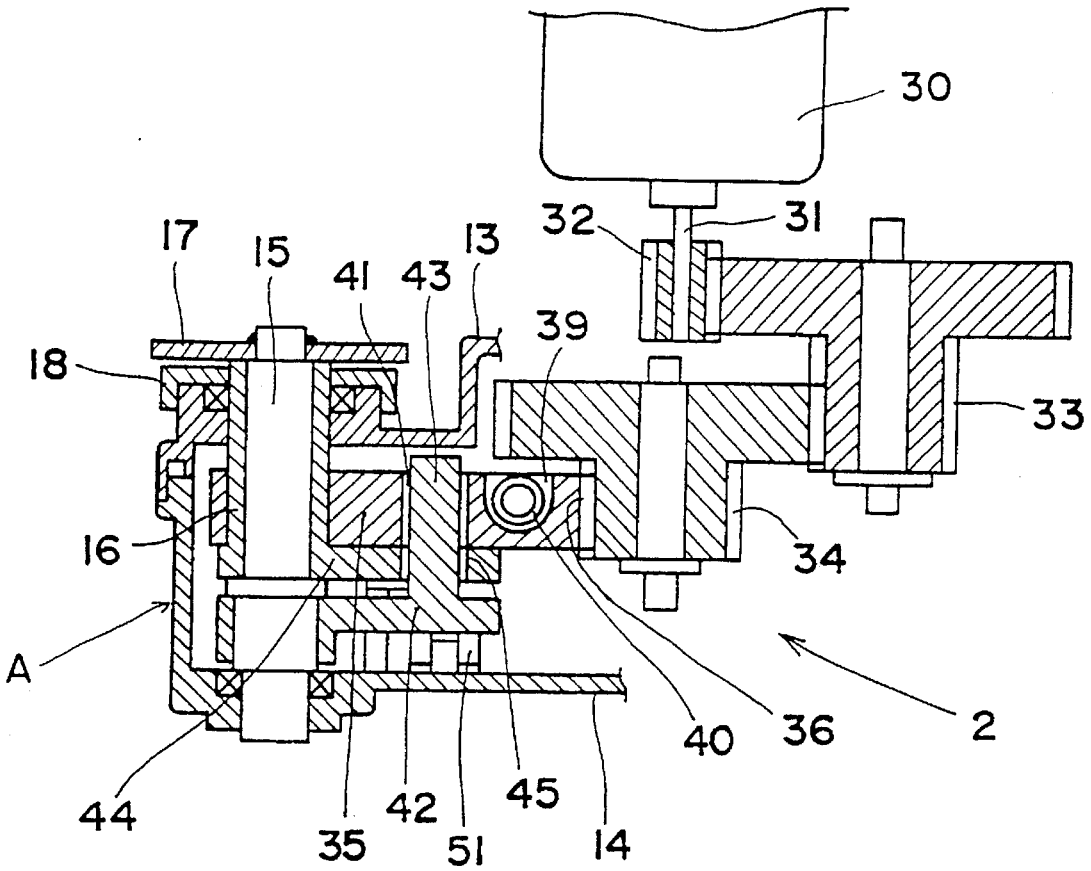
FIG. 3 is a partially omitted longitudinal-sectional view of an actuator.
Figure 4:
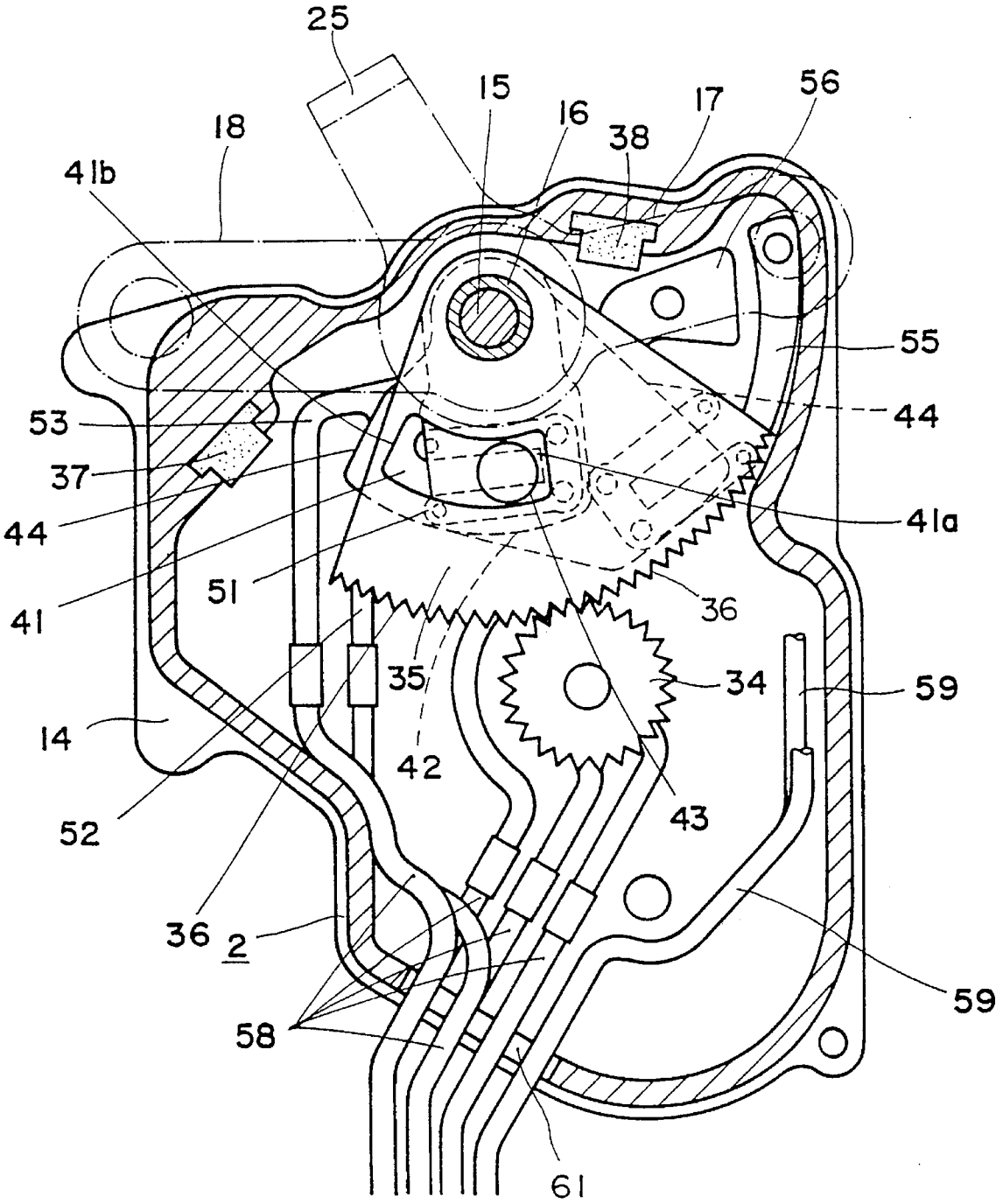
FIG. 4 is a cross sectional view of the actuator.
Figure 6:
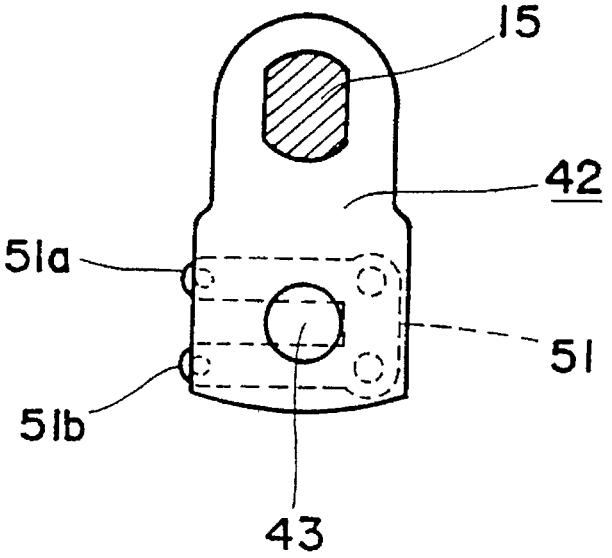
FIG. 6 is a plane view of a first lever.
Figure 7:
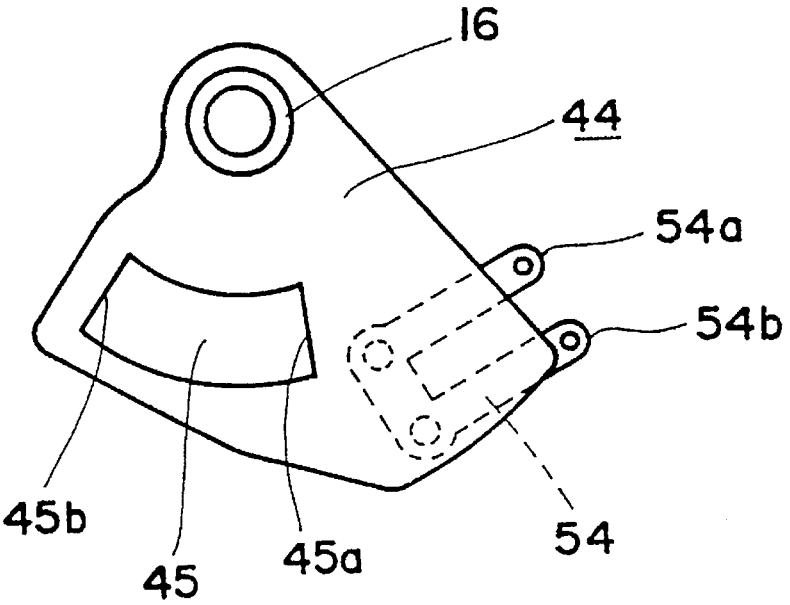
FIG. 7 is a plane view of a second lever.

The output member 35 shown in FIG. 4 is located at the neutral position. As the motor 30 rotates, the output member 35 rotates in either direction until it is brought into contact with the rubber stopper 37 or 38 which is fixed at the base case 14. A concave portion 39 of which the section is U-shaped is formed at the output member 35 as shown in FIG. 3, and a spring 40 which returns the output member 35 to the neutral position is accommodated in the concave portion 39. Furthermore, in FIG. 4, to simplify the view, the concave portion 39 and spring 40 are not illustrated.

An arcuate slot 41 is formed at the output member 35 centering around the second shaft 16. As shown in FIG. 3, a second lever 44 is arranged at the lower side of the output member 35. The second lever 44 disclosed in the preferred embodiment is integrally formed at the lower position of the second shaft 16. An arcuate slot 45 of which the size is equal to that of the arcuate slot 41 of the output member 35 is formed at the second lever 44. The second lever 44 fixed at the second lock lever 18 via the second shaft 16 is also held at the neutral position shown in FIG. 4 by the action of the key cylinder 19 when the key cylinder 19 is not operated. In a case where both the second lever 44 and output member 35 are located at the neutral position, the two arcuate slots 41 and 45 will be completely overlapped.

As shown in FIG. 3, a first lever 42 is fixed at the lower part of the first shaft 15. A pin 43 which extends upwards and is inserted in the two arcuate slots 41 and 45 is formed at the first lever 42. The left and right length of the respective arcuate slots is set to such a length as the movements of the pin 43 can be absorbed when the first lock lever 17 is changed over to the UNLOCK position or LOCK position, and it is composed so that, even though the first lock lever 17 is rotated by the lock button 21 when the arcuate slots 41 and 45 are located at the neutral position, the pin 43 is not engaged with the arcuate slots 41 and 45.

In FIG. 4, the pin 43 which is interlocked with the first lock lever 17 is located at the unlocked position while the arcuate slots 41 and 45 are located at the neutral positions. In this state, if the first lock lever 17 is rotated clockwise toward the lock position, the pin 43 moves only to the left side of the arcuate slots 41 and 45 and will not cause the arcuate slots 41 and 45 to be moved. In a case where the second lock lever 18 or the output member 35 is rotated clockwise in FIG. 4, either the arcuate slot 41 or 45 is engaged with the pin 43 and causes the pin 43 to be moved to the left side, thereby causing the first lock lever 17 to be changed over to the LOCK position.

Figure 5:
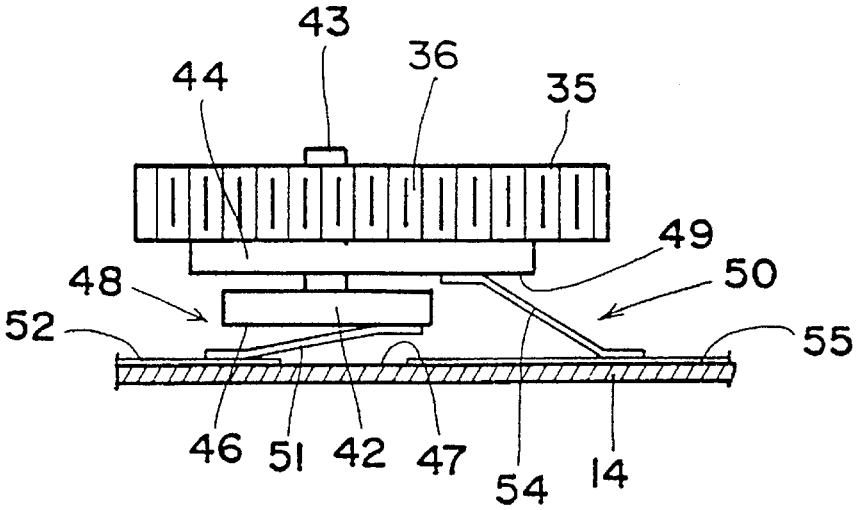
FIG. 5 is a side elevation view showing two switch mechanisms.

As shown in FIG. 5, a switch mechanism 48 to detect whether the locking device is in the locked state or unlocked state is provided between a reverse surface 46 of the first lever 42 and an inner surface 47 of the lower case 14, and another switch mechanism 50 to detect the operation of the key cylinder 19 is provided between a reverse surface 49 of the second lever 44 and the inner surface 47 of the lower case 14.

The switch mechanism 48 to detect the state consists of a fork-like moving contact 51 fixed on the reverse surface 46 of the first lever 42 and a pair of fixed contacts 52 and 53 (FIG. 8, FIG. 9) arranged on the inner surface 47 of the lower case 14. While the first lever 42 is located at the unlocked position, the moving contact 51 causes the fixed contact 52 to communicate with the fixed contact 53. As the first lever 42 enters the lock position in FIG. 9, the moving contact 51 is separated from the fixed contact 52, thereby causing the communication thereof to be interrupted.

Figure 10:
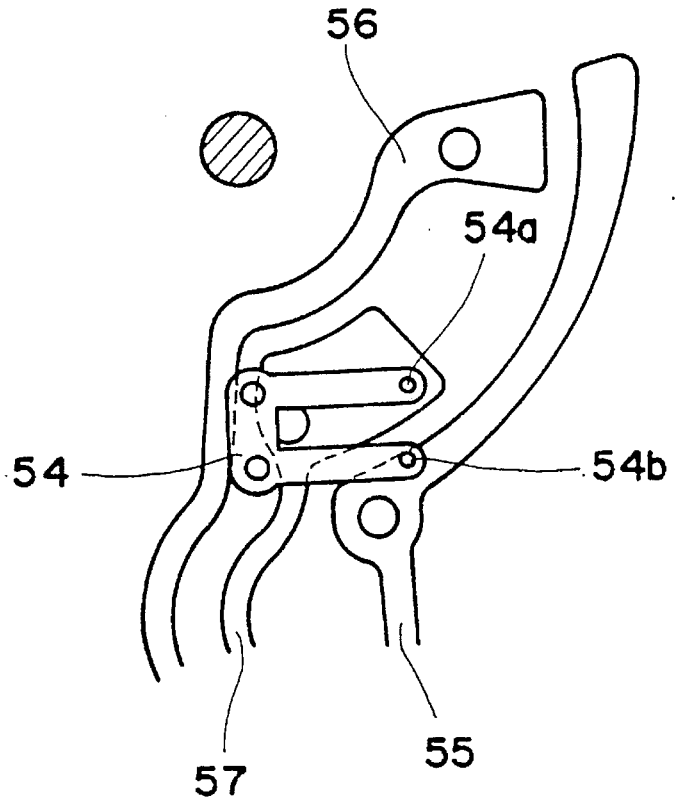
FIG. 10 is a plane view when the key operation detecting switch mechanism detects LOCK.
Figure 11:
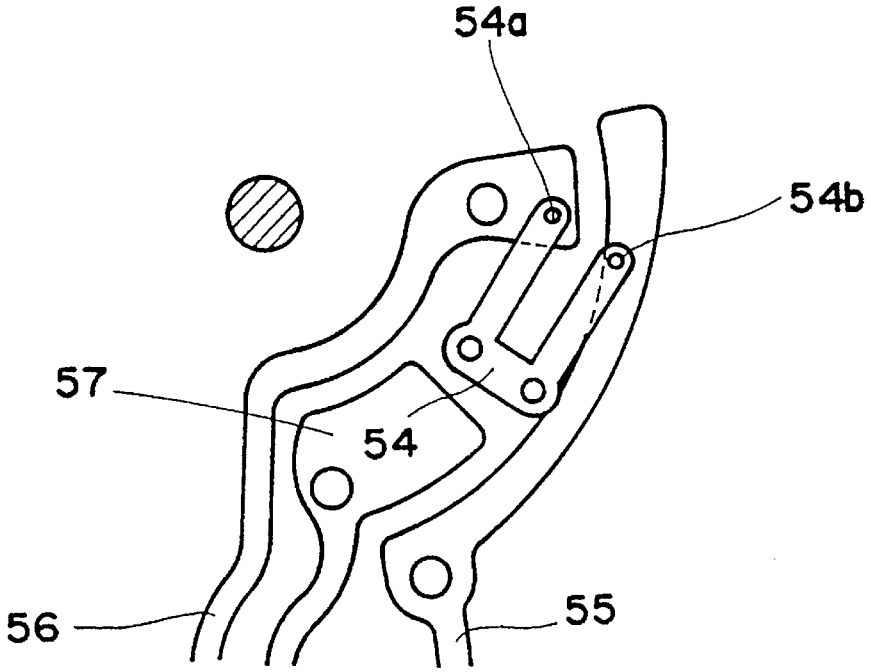
FIG. 11 is a plane view when the key operation detecting switch mechanism detects UNLOCK.

The switch mechanism 50 to detect the key operation is comprised of a fork-like moving contact 54 fixed on the reverse surface 49 of the second lever 44, three fixed contacts 55, 56, and 57 arranged on the inner surface 47 of the lower case 14. The second lever 44 which moves integrally with the key cylinder 19 is always located at the neutral position of FIG. 8. In this state, the moving contact 54 is in contact with only the common fixed contact 55. As the second lever 44 enters the lock position in FIG. 10, the moving contact 54 causes the common fixed contact 55 to communicate with the locking fixed contact 57, thereby causing the locking operation of the key cylinder 19 to be detected.

As made clear from the above description and figures related thereto, the two switch mechanisms 48 and 50 are installed in the housing A of the actuator 2, utilizing the space where the output member 35 moves. For this reason, it is possible to maintain the size of the housing A at the same size as that of a conventional type. Five cables 58 connected to the respective fixed contacts and a pair of cables 59 connected to the motor 30 are led outside through the opening 60 formed at the housing A. Thus, as the cables are gathered and arranged at one place, it will become simple to route the cables.

OPERATION

Figure 8:
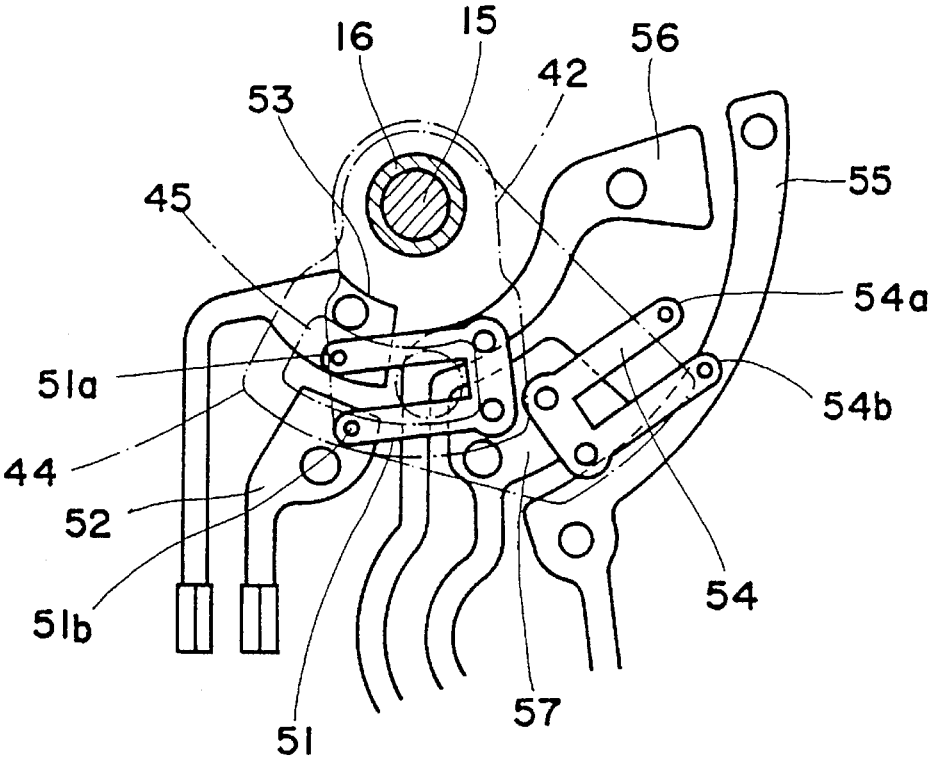
FIG. 8 is a relational view of the switch mechanisms in an unlocked state.
Figure 9:
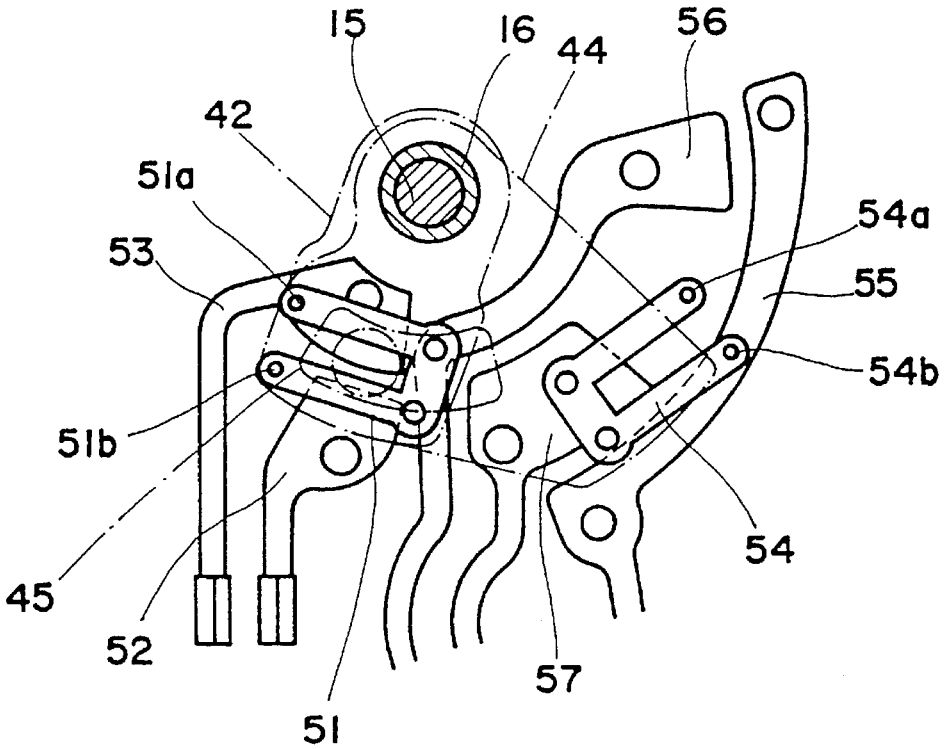
FIG. 9 is a view of the switch mechanisms in a locked state.

When the first (or inside) lock lever 17 is located at the position shown with a solid line in FIG. 1, the first lever linked to the first lock lever 17 via the first shaft 15 is located at the position shown in FIG. 8. In this state, the moving contact 51 attached to the first lever causes the fix contacts 52 and 53 to communicate with each other, thereby causing the UNLOCK state to be detected.

In this state, when an operation signal is received from the remote control transmitter as an example, the locking device supplies electric current for locking to the motor 30 in order to change over to the LOCK state since the door is now in the unlocked state. Then, the motor 30 causes the output member 35 to be rotated clockwise in FIG. 4 via the reduction gears 33 and 34, and the right wall 41*a* of the arcuate slot 41 of the output member 35 causes the engaging pin 43 of the first lever 42 to be pushed leftwards, thereby causing the first lever 42 to be rotated clockwise. Thus, the first lock lever 17 linked to the first lever 42 is displaced from the solid line position to the dashed line position in FIG. 1. And the locking device is changed over to the lock state.

Furthermore, in the states shown in FIG. 1 and FIG. 4, as the second lock lever 18 is rotated in the locking direction (counterclockwise direction) by the key cylinder 19, the right wall 45*a* of the arcuate slot 45 of the second lever 44 causes the engaging pin 43 of the first lever 42 to be pushed leftwards and rotates the first lever 42 clockwise. Then, the first lock lever 17 linked to the first lever 42 is displaced from the solid line position to the dashed line position in FIG. 1, thereby causing the locking device to be changed over to the lock state. Simultaneously, the moving contact 54 attached to the second lever 44 is moved from the position in FIG. 8 to that in FIG. 10 to cause the common fixed contact 55 and the locking fixed contact 57 to communicate with each other, thereby causing the locking operation of the key cylinder 19 to be detected. The detection signal of the locking operation, for example, is supplied to the central door lock system, and the remaining locking devices are changed to the lock state.

What is claimed is:

1. A vehicle door locking device comprising:

a first locking lever connected to a lock button installed at an inside surface of the door and used for changing over the locking device to a lock state or an unlock state;

a second locking lever connected to a key cylinder installed at an outside surface of the door;

an actuator having a substantially enclosed housing, a motor accommodated in the housing, a first shaft fixed to the first locking lever and a second shaft fixed to the second locking lever;

said first shaft being coaxially rotatable within said second shaft;

a first switch mechanism for detecting the position of the first locking lever operably connected to the first locking lever and slidably engaged on the housing;

a second switch mechanism operably connected to the second locking lever and slidably engaged on the housing for detecting the position of the second locking lever; and wherein said first switch mechanism and said second switch mechanism are provided in the housing and the first locking lever and second locking lever are located outside the housing.

2. A vehicle door locking device as set forth in claim 1, wherein the first switch mechanism has a first moving contact attached to the first shaft and first fixed contacts attached to an inner surface of the housing, and the second switch mechanism has a second moving contact attached to the second shaft and second fixed contacts attached to the inner surface of the housing, and the first fixed contacts and the second fixed contacts are arranged on the same plane.

3. A vehicle door locking device as set forth in claim 1, wherein the actuator is provided with an output member which causes the first shaft to be rotated by being swung in an appointed range by the motor, and the first switch mechanism and the second switch mechanism are arranged between the output member and an inner surface of the housing.

4. A vehicle door locking device as set forth in claim 1, wherein the actuator is further provided with a first lever fixed to the first shaft, a second lever fixed to the second shaft, and an output member which causes the first shaft to be rotated by being swung in an appointed range by the motor; the first shaft and second shaft respectively have first and second exposed ends which protrude from the housing; the first locking lever and second locking lever are respectively fixed at the first and second exposed ends; the first switch mechanism has a first moving contact attached to the first lever and first fixed contacts attached to the inner surface of the housing; the second switching mechanism has a second moving contact attached to the second lever and second fixed contacts attached to the inner surface of the second housing; and the output member, the first lever and the second lever are mutually arranged in parallelism.

5. A vehicle door locking device as set forth in claim 1, wherein the housing is provided with an inlet/outlet port for cables to be connected to the first switch mechanism and the second switch mechanism.

6. A vehicle door locking device as set forth in claim 1, wherein cables to be connected to the motor are also attached to the inlet/outlet port.

* * * * *